United States Patent [19]

Holzgrefe

[11] Patent Number: 5,044,561

[45] Date of Patent: Sep. 3, 1991

[54] INJECTION VALVE FOR FUEL INJECTION SYSTEMS

[75] Inventor: Volker Holzgrefe, Ditzingen, Fed. Rep. of Germany

[73] Assignee: Robert Bosch GmbH, Stuttgart, Fed. Rep. of Germany

[21] Appl. No.: 126,073

[22] Filed: Nov. 24, 1987

[30] Foreign Application Priority Data

Dec. 19, 1986 [DE] Fed. Rep. of Germany ..... 3643523

[51] Int. Cl.[5] ..... F02M 61/20

[52] U.S. Cl. ..... 239/491; 239/585

[58] Field of Search ..... 239/600, 585, 473, 482, 239/483, 584, 490, 491, 533.3-533.12, 463

[56] References Cited

U.S. PATENT DOCUMENTS

| | | | |
|---|---|---|---|
| 1,171,140 | 2/1916 | Robertson | 239/482 |
| 1,481,597 | 1/1924 | Forster | 239/482 |
| 1,518,449 | 12/1924 | Plantinga | 239/473 X |
| 4,060,199 | 11/1977 | Brüne et al. | 239/488 |
| 4,173,069 | 12/1979 | Knapp et al. | 239/585 |
| 4,274,598 | 6/1981 | Wilfert et al. | 239/585 |
| 4,350,301 | 9/1982 | Erwin et al. | 239/584 X |
| 4,365,746 | 12/1982 | Tanasawa et al. | 239/583 X |
| 4,651,931 | 3/1987 | Hans et al. | 239/533.9 |
| 4,732,327 | 3/1988 | Aichele et al. | 239/600 X |

FOREIGN PATENT DOCUMENTS

| | | | |
|---|---|---|---|
| 20758 | of 1912 | United Kingdom | 236/533 R |
| 9382 | of 1915 | United Kingdom | 239/533 R |
| 435422 | 9/1935 | United Kingdom | 239/491 |
| 2140626 | 11/1984 | United Kingdom | 239/585 |

*Primary Examiner*—Andres Kashnikow
*Assistant Examiner*—Kevin Weldon
*Attorney, Agent, or Firm*—Edwin E. Greigg; Ronald E. Greigg

[57] ABSTRACT

An injection valve for fuel injection systems of internal combustion engines which is used for injection of fuel into the intake tube. The injection valve includes a valve housing in which a core that cooperates with an armature is located. Connected to the valve housing is a nozzle body in which a conical valve seat face is formed, with which a sealing section of a valve needle actuated by the armature cooperates. The valve needle is guided by guide sections in a guide bore of the nozzle body, and upstream of the sealing section, the valve needle has a cylindrical section which protrudes through a central opening of an insert body. The insert body rests with a jacket sealing face on the valve seat face and has flow openings that lead from upstream to downstream of the insert body and are aimed at the valve seat face.

17 Claims, 2 Drawing Sheets

Fig. 3
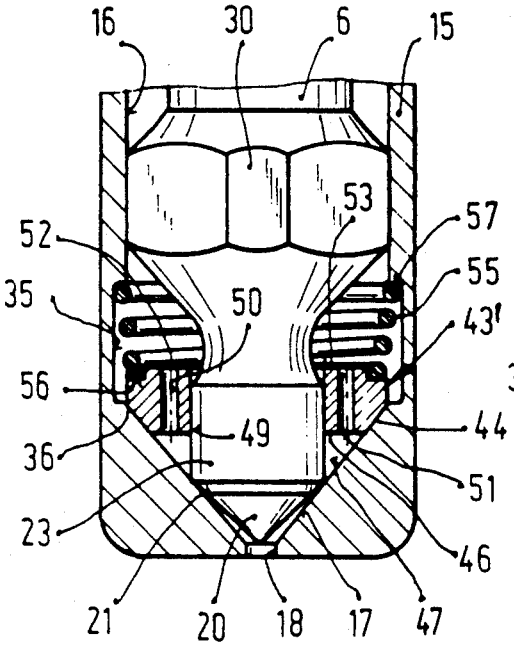
Fig. 4
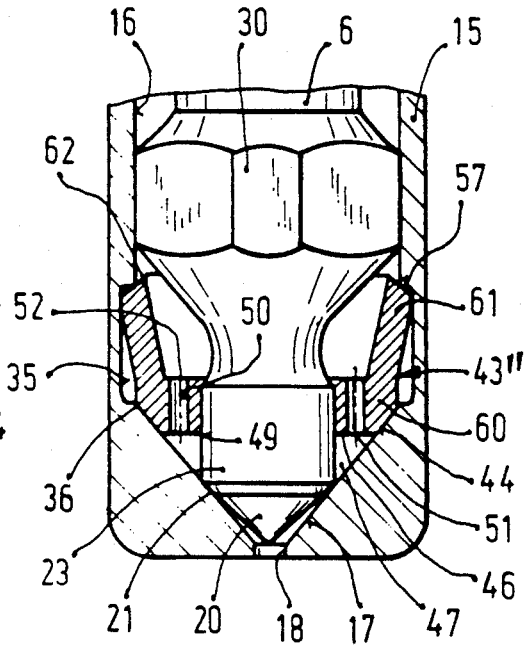
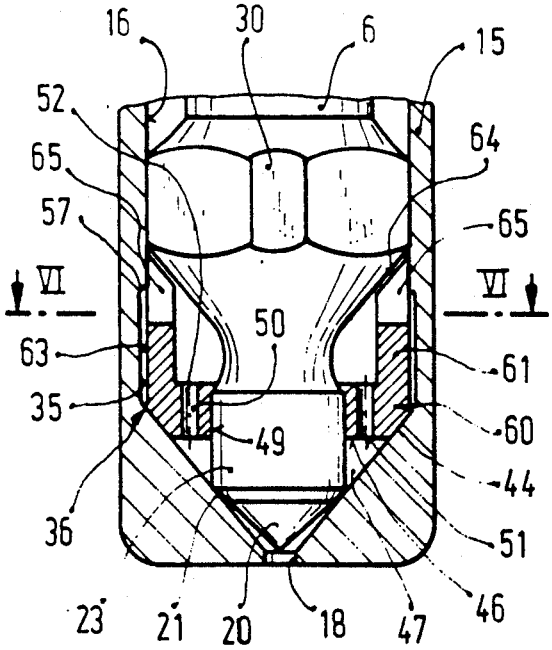
Fig. 5
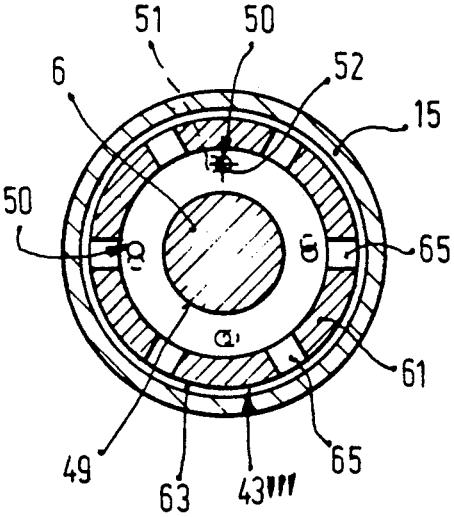
Fig. 6

INJECTION VALVE FOR FUEL INJECTION SYSTEMS

BACKGROUND OF THE INVENTION

The invention is based on an injection valve as defined hereinafter. An injection valve is already known in which flow openings extend in an insert body such that the fuel streams emerging from them are aimed at the valve needle. As a result, the fuel must first be deflected toward the valve seat face, causing flow losses that reduce the energy available for fuel preparation.

An injection valve is also known in which to improve the sprayed fuel stream, swirl grooves are provided upstream of the valve seat, extending parallel to the longitudinal axis of the valve, which serve to make the fuel turbulent even before it flows through the valve seat. These swirl grooves impose a tangential force component upon the fuel emerging from the spray opening, causing the fuel to be ejected in a conical spray pattern. This inherently favorable effect can be only partly exploited in this known injection valve, however, because after emerging from the swirl grooves, which are machined into the circumference of the valve needle, the fuel flows into the vicinity of the undercut (which is required for manufacturing reasons), where it is slowed down severely. A further disadvantage of this known injection valve is that the metering of the fuel quantity injected per unit of time is determined, in such an injection valve, by the size of the flow cross section of the spray opening downstream of the valve seat with the valve opened. As a result, over relatively long operation the deposits that unavoidably form during use can reduce the cross section, hence leading to reduced flow-through quantities. This phenomenon of "leaning down" is feared. It also arises with other embodiments of the metering zone, as long as such a zone is located downstream of the valve seat and hence is exposed to the atmosphere of the intake tube.

Another known injection valve, by comparison, offers the advantage that the quantity of fuel to be sprayed is metered upstream of the valve seat. To this end, metering bores are provided in the lower guide section of the valve needle, by way of which bores the fuel flows with a pressure drop. No provisions are apparent for generating any swirl in the fuel, however. Furthermore, the disposition of the metering bores on the valve needle is disadvantageous from a manufacturing standpoint because it also requires machining of the high-quality valve needle material. For atomizing the fuel, there is a needle pintle located inside the spray opening.

OBJECT AND SUMMARY OF THE INVENTION

The injection valve according to the invention has an advantage over the prior art of improving known injection valves in a simple fashion such that, without directly changing their construction and using easily machined materials, it becomes possible to generate a fuel swirl and to perform fuel metering upstream of the valve seat face. The improved valve includes an insert body having flow openings through which the fuel emerges from the flow openings flows through the valve seat and the spray opening without braking, with high kinetic energy, so that high-speed flow impact and very good fuel preparation are attained.

It is advantageous for the insert body to be elongated, to avoid its assuming a tilted position. It may also be advantage for the insert body to be fixed in the axial direction.

The invention will be better understood and further objects and advantages thereof will become more apparent from the ensuing detailed description of preferred embodiments taken in conjunction with the drawings.

BRIEF DESCRIPTION OF THE DRAWINGS

FIG. 3 is a fragmentary view of a second exemplary embodiment of an injection valve;

FIG. 4 is a fragmentary view of a third exemplary embodiment of an injection valve;

FIG. 5 is a fragmentary view of a fourth exemplary embodiment of an injection valve; and FIG. 6 is a section taken along the line VI—VI of FIG. 5.

DESCRIPTION OF THE PREFERRED EMBODIMENTS

Figure 1:
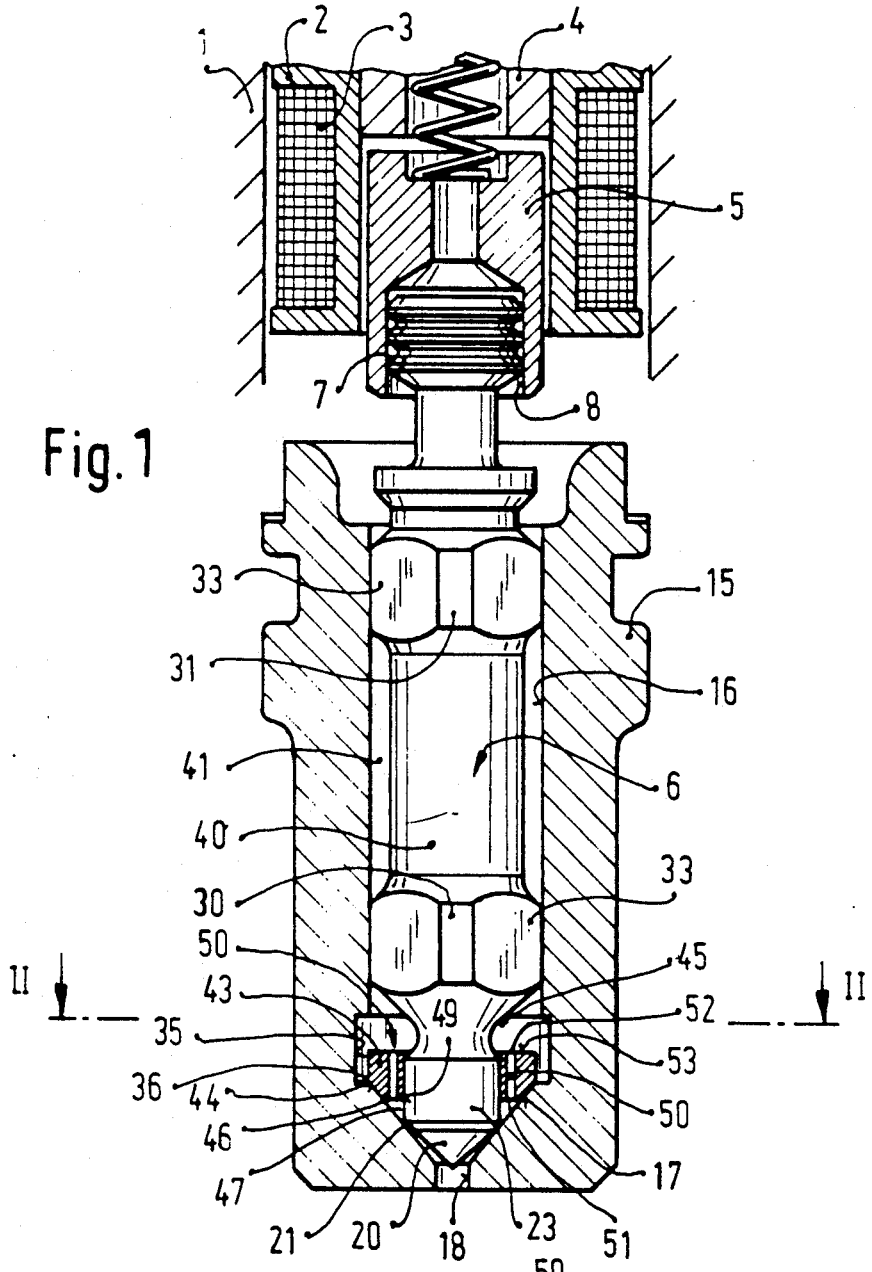
FIG. 1 is a section taken through a first exemplary embodiment of an injection valve.

FIG. 1 shows a valve housing 1 of an injection valve, not shown in further detail, for fuel injection systems of mixture-compressing internal combustion engines having externally supplied ignition. Located inside this valve housing 1 is a magnet coil 3 mounted on a coil holder 2. A ferromagnetic core 4 is located inside the coil holder 2, partly surrounded by the magnet coil 3. An armature 5 is also located partly inside the coil holder 2, oriented toward one face end of the core 4, and is fixedly connected to a valve needle 6, which in turn is fitted with one end 7 into a recess 8 of the armature 5. The valve needle 6 is displaceably supported in a nozzle body 15, which is connected in a known manner not shown with the valve housing 1. The nozzle body 15 has a coaxial guide bore 16, which is adjoined in the direction remote from the magnet coil 3 by a conically tapering valve seat face 17, which in turn terminates in a spray opening 18. The valve needle 6 is guided in the guide bore 16 of the nozzle body 15, and in the direction remote from the magnet coil 3 this valve needle terminates in a conical end section 20, which adjoins a cylindrical section 23 by a narrow sealing section 21. When the injection valve is closed, this sealing section 21 rests directly on the conical tapering valve seat face 17 of the nozzle body 15. To open the injection valve, the valve needle 6, with this sealing section 21, lifts away from the valve seat face 17 and thus opens up a flow opening for the fuel. The conical end section 20 may still protrude partway with its tip into the spray opening 18. Also, the conical section may as shown terminate in a cone, or it may have a needle pintle, which forms a coaxial prolongation of the valve needle 6 and may protrude from the spray opening 18 of the nozzle body 15.

The valve needle 6 also has, adjoining the sealing section 21, a cylindrical section 23, and adjoining that are two axially spaced guide sections 30 and 31 which provide guidance for the valve needle 6 inside the guide bore 16. On their perimeter, the guide sections 30, 31 form in conjunction with the bore 16 flow openings 33, which may for example be embodied as faces, so that the flow openings are generally in the form of squares, or rectangles, for example formed between cylindrical portions which form the guide sections 30, 31.

The guide bore 16 of the nozzle body 15 that receives the guide sections 30 and 31 is stepped, in the direction remote from the magnet coil 3 near the valve seat face 17, in the form of an enlargement 35 dictated by manufacturing considerations. The diameter of the enlargement 35, which may also be called an "undercut", is greater than the diameter of the guide bore 16. The enlargement 35 is adjoined by the aforementioned valve seat face 17 with its base diameter 36.

Between the guide sections 30 and 31, the valve needle 6 has a connecting section 40 of reduced diameter as compared with these guide sections; in the radial direction, along with the guide bore 16, the guide sections 30, 31 and the connecting section 40 define an annular flow conduit 41.

Figure 2:
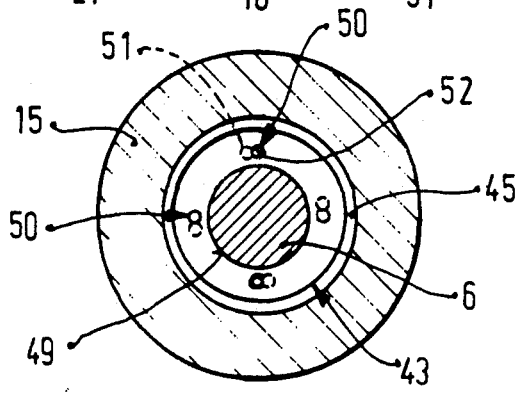
FIG. 2 is a section taken along the line II—II of FIG. 1.

According to the invention, an annular insert body 43 is introduced into the guide bore 16, resting with a conical jacket sealing face 44 on the valve seat face 17 and thus dividing an upper chamber 45, formed between the guide section 30 and the insert body 43, from a lower chamber 47 defined by the cylindrical section 23, the valve seat face 17 and the lower end face 46 of the insert body 43. The cylindrical section 23 of the valve needle 6 protrudes with little play through a central opening 49 of the insert body 43. The insert body 43 is penetrated by at least one flow opening 50. As shown in FIG. 2, in the present exemplary embodiment there are four flow openings 50, at which when the sealing section 21 is raised from the valve seat face 17 the fuel flowing through from the upper chamber 45 to the lower chamber 47 undergoes a pressure drop of for instance approximately 20% of the pressure difference that is available between the upper chamber 45 and the spray opening 18. The flow openings 50 can accordingly more or less serve the purpose of fuel metering. The openings 51 of the flow openings 50 discharge into the lower chamber 47 with the fuel aimed at the valve seat face 17, so that the fuel streams emerging from the discharge openings strike the valve seat face 17 directly, without being deflected. The flow openings 50 may advantageously have an inclined course relative to the longitudinal axis of the valve, so as to generate a swirl; the inclination of the flow openings 50 may also extend either such that the discharge openings 51 are spaced more closely apart radially from the cylindrical section 23 of the valve needle 6 than the inlet openings 52 of the flow openings 50, or such that a tangential component is imparted to the fuel streams, as shown in FIG. 2. As a result of the different fuel pressure forces on its upper end face 53 and its lower end face 46, the inset body 43 is pressed with its jacket sealing face 44 against the valve seat face 17, making further sealing at the circumference unnecessary. Because there is little play between the cylindrical section 23 and the central opening 49 of the insert body 43, there is only a slight constant leakage flow. Stringent demands are not placed on the material comprising the insert body 43, so that a less-expensive, easily machined material can be used for this part.

In the second exemplary embodiment of the invention shown in FIG. 3, elements remaining the same as and functioning like those of FIGS. 1 and 2 are identified by the same reference numerals. In contrast to the exemplary embodiment of FIGS. 1 and 2, in the second exemplary embodiment of FIG. 3 the insert body 43' is no longer loosely movably disposed in the nozzle body 15 but instead is urged toward the valve seat face 17 by a spring 55, which engages a step 56 on the upper end face 53 of the insert body 43 and on its other end is braced against a shoulder 57 in the nozzle body 15 that is formed between the guide bore 16 and the enlargement 35. The disposition of the spring 55 makes it possible to prevent possibly excessive axial movements by the insert body 43' during rough vehicle operation. The spring shown in FIG. 3 is embodied as a conical spring, by way of example, but some other spring shape can also be used to attain the spring force.

In the exemplary embodiment of an injection valve according to the invention shown in FIG. 4, elements identical to and functioning like those of the foregoing embodiments are again identified by the same reference numerals, and these elements that have already been described need not be described again here. In the third exemplary embodiment in FIG. 4, the insert body 43'' is cup-shaped and has a bottom portion 60 oriented toward the valve seat face 17 and an annular rim 61 oriented toward the guide section 30. The jacket sealing face 44 that cooperates with the valve seat face 17 is formed on the bottom portion 60, remote from the annular rim 61. The central opening 49 and the flow opening 49 and the flow openings 50 also penetrate the bottom in the manner described above. After the insertion of the insert body 43'' into the nozzle body 15, the annular rim 61 is bent radially outward in such a way that with its rim end face 62 oriented toward the guide section 30 it comes to rest on the shoulder 57, so that the jacket sealing face 44 is pressed sealingly against the valve seat face 17, and the insert body 43 remains fixed in this position during use even when jarred.

In the fourth exemplary embodiment of the invention shown in FIGS. 5 and 6, once again elements identical to and functioning like those of the foregoing embodiments are identified by the same reference numerals. In the exemplary embodiment of FIGS. 5 and 6, the insert body 43'' is cup-shaped as in the embodiment of FIG. 4, having a bottom portion 60 and an annular rim 61, but in this case it is embodied so that in the direction toward the guide section 30 it rests with little play on the guide bore 16, preventing tilting of the insert body 43 relative to the valve needle 6. The jacket 63 of the annular rim 61 thus extends cylindrically. The rim end face 64 oriented toward the guide section 30 is preferably oblique, corresponding to the course of the valve needle 6 in this region. Through openings 65 that are open toward the rim end face 64 penetrate the annular rim 61 and serve to guide fuel from the guide section 30 to the flow openings 50; in this exemplary embodiment, six through openings 65 are provided, distributed uniformly over the circumference.

As in the exemplary embodiment of FIGS. 1 and 2, the insert body 43''' of the exemplary embodiment of FIGS. 5 and 6 is again disposed loosely in the axial direction in the nozzle body 15 and is acted upon in a sealing fashion, in the direction toward the valve seat face 17, solely by the various fuel pressures.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An injection valve for fuel injection systems of internal combustion engines, comprising a nozzle body, a conical valve seat face that tapers conically from a cylindrical base diameter, an axial spray opening in said nozzle body adjoining the valve seat face, a valve needle which has a sealing section (21) cooperating with a first portion of the valve seat face and a cylindrical section (23) upstream from and adjoining said sealing section and at least one guide section that with its circumference guides the valve needle in a guide bore of the nozzle body (15), an annular insert body (43) is arranged downstream of said at least one guide section juxtaposed and surrounding said cylindrical section of said valve needle, said annular insert body having at least one flow opening extending from upstream to downstream of the insert body, said insert body including a jacket sealing face which seals against a second portion of said conical valve seat face between said sealing section and said at least one guide section of said valve needle, said valve needle includes a cylindrical section which protrudes with little play through a central opening of said insert body and said at least one flow opening in said annular insert body is aimed at a third portion of said valve seat face upstream of said first portion arranged to cooperate with the sealing section of the valve needle.

2. An injection valve as defined by claim 1, in which said insert body is engaged on one end by a spring (55) that urges said insert body in a direction toward said second portion of said valve seat face (17).

3. An injection valve as defined by claim 1, characterized in that upstream of the valve seat face (17), the guide bore (16) has a shoulder (57), on which an annular rim (61) of the insert body (43) is supported.

4. An injection valve as defined by claim 1, in which said jacket sealing face (44) of said insert body extends at approximately the same angle as said valve seat face (17) and rests thereon.

5. An injection valve as defined by claim 1, in which there are more than one flow opening and each flow opening (50) extends in an inclined manner with respect to the guide bore (16), in order to generate a swirl.

6. An injection valve as defined by claim 1, in which said at least one flow opening (50) is used for fuel metering.

7. An injection valve as defined in claim 5, wherein each of said flow openings is used for fuel metering.

8. An insert body for use in an injection valve for an internal combustion engine which comprises a central axial bore through which an end portion of a valve needle passes, a plurality of equally spaced openings which extend from upstream to downstream through said insert body through which fuel flows, and said insert body further includes a bottom portion and an upwardly extending rim.

9. An insert as set forth in claim 8, in which, said plurality of equally spaced openings slope at an angle relative to a vertical plane through a longitudinal axis which cuts an upper end of said opening.

10. An insert as set forth in claim 8, in which said upwardly extending rim further includes an outwardly flared annular portion.

11. An injection valve for fuel injection systems of internal combustion engines, comprising a nozzle body, a conical valve seat face that tapers conically from a cylindrical base diameter, an axial spray opening in said nozzle body adjoining the valve seat face, a valve needle which has a sealing section cooperating with a first portion of the valve seat face and a cylindrical section upstream from and adjoining said sealing section and at least one guide section that has a perimeter that includes flow openings, and cylindrical portions that guide the valve needle in a guide bore of the nozzle body (15), an annular cup-shaped insert body (43) is arranged downstream of said at least one guide section juxtaposed and surrounding said cylindrical section of said valve needle, said annular cup-shaped insert body includes a bottom portion (60) oriented toward said valve seat face, at least one flow opening extending from upstream to downstream of said bottom portion of said cup-shaped insert body, said cup-shaped insert body including an annular rim (61) oriented toward said at least one guide section (30) of said valve needle (6), a jacket sealing face which seals against a second portion of said conical valve seat face between said sealing section and said at least one guide section of said valve needle, said valve needle includes a cylindrical section which protrudes with little play through a central opening (49) of said cup-shaped insert body and said at least one flow opening in said annular cup-shaped insert body is aimed at a third portion of said valve seat face upstream of the portion arranged to cooperate with the sealing section of the valve needle.

12. An insert as set forth in claim 11, in which, said at least one opening slopes at an angle relative to a vertical plane through a longitudinal axis which cuts an upper end of said opening.

13. An injection valve as defined by claim 11, in which at least one radial through opening (65) is provided in said annular rim (61).

14. An insert body for use in an injection valve for an internal combustion engine which comprises;

a bottom portion and an upwardly extending rim, a central axial bore through said bottom portion through which an end portion of a valve needle passes, a plurality of equally spaced openings which extend from upstream to downstream through said bottom portion of said insert body through which fuel flows, and said upwardly extending rim is provided with through openings which are distributed uniformly over the circumference thereof.

15. An insert as set forth in claim 14, in which, each of said plurality of equally spaced openings slope at an angle relative to a vertical plane through a longitudinal axis which cuts an upper end of said opening.

16. An insert body in combination with a spring for assembly in a central bore in an injection valve for an internal combustion engine through which an end portion of a valve needle passes to seat upon a conical valve seat, in which;

said insert body includes a plurality of equally spaced openings which extend from upstream to downstream through said insert body through which fuel flows, and said spring means is positioned within said central bore relative to said insert body to urge said insert body against a portion of said valve seat face of said injection valve to seat thereon.

17. An injection valve as defined by claim 11, in which said insert body is engaged on one end by a spring (55) that urges said insert body in a direction toward said second portion of said valve seat face (17).

* * * * *